US009737463B2

(12) United States Patent
Rosskamm

(10) Patent No.: US 9,737,463 B2
(45) Date of Patent: Aug. 22, 2017

(54) BABY BOTTLE ASSEMBLY INCLUDING A DIAPHRAGM THAT AUGMENTS A BABY'S ABILITY TO REMOVE LIQUID FROM A RECEPTACLE

(71) Applicant: C & A Marketing, Inc., Edison, NJ (US)

(72) Inventor: Avraham Yeshayah Rosskamm, Chestnut Ridge, NY (US)

(73) Assignee: C & A Marketing, Inc., Edison, NJ (US)

( * ) Notice: Subject to any disclaimer, the term of this patent is extended or adjusted under 35 U.S.C. 154(b) by 0 days.

(21) Appl. No.: 15/008,386

(22) Filed: Jan. 27, 2016

(65) Prior Publication Data

US 2016/0213573 A1 Jul. 28, 2016

Related U.S. Application Data

(60) Provisional application No. 62/108,311, filed on Jan. 27, 2015.

(51) Int. Cl.

| | |
|---|---|
| ***A61J 9/04*** | (2006.01) |
| ***A61J 9/00*** | (2006.01) |
| *A61J 11/00* | (2006.01) |

(52) U.S. Cl.

CPC ..... *A61J 9/006* (2013.01); *A61J 9/04* (2013.01); *A61J 11/0085* (2013.01)

(58) Field of Classification Search

CPC ... A61J 9/04; A61J 9/006; A61J 11/001; A61J 11/0005; A62J 11/002

USPC ..... 215/11.5

See application file for complete search history.

(56) References Cited

U.S. PATENT DOCUMENTS

| | | | | |
|---|---|---|---|---|
| 4,301,934 A * | 11/1981 | Forestal | ..... | A61J 9/006 215/11.4 |
| 4,754,887 A * | 7/1988 | Ou | ..... | A61J 9/00 215/11.1 |
| 4,898,290 A * | 2/1990 | Cueto | ..... | A61J 9/00 215/11.1 |

(Continued)

FOREIGN PATENT DOCUMENTS

| | | |
|---|---|---|
| CN | 203663109 | 6/2014 |

OTHER PUBLICATIONS

App No. PCT/US2016/015226 International Search Report, dated Apr. 11, 2016.

(Continued)

*Primary Examiner* — Sue A Weaver

(74) *Attorney, Agent, or Firm* — Weiss & Arons LLP; Avi Goldenberg, Esq.

(57) ABSTRACT

Apparatus and methods for a baby bottle assembly are provided. The baby bottle assembly may include a nipple and an internally threaded collar configured to receive a bottom portion of the nipple. The assembly may also include a receptacle including an externally threaded neck and a cylindrical surface defining a mouth of the receptacle. The assembly may further include a bottle insert including a flange, the flange having an outer circumference greater than or equal to a circumference of the mouth. A top surface of the bottle insert may include a plurality of apertures and a top portion of a hollow protrusion. A bottom surface of the bottle insert may include a bottom portion of the hollow protrusion, the plurality of apertures and a diaphragm.

21 Claims, 10 Drawing Sheets

(56) References Cited

U.S. PATENT DOCUMENTS

| | | | | |
|---|---|---|---|---|
| 4,929,229 | A | 5/1990 | Larsson | |
| 5,474,193 | A * | 12/1995 | Larsson | A61J 9/00 215/11.4 |
| 5,660,301 | A | 8/1997 | Kaplowitz | |
| 5,749,483 | A * | 5/1998 | Tebeau | A61J 9/00 215/11.1 |
| 5,791,503 | A * | 8/1998 | Lyons | A61J 9/00 215/11.1 |
| 6,250,487 | B1 | 6/2001 | Tebeau | |
| 7,984,817 | B1 * | 7/2011 | Everett | A61J 9/006 215/11.5 |
| 8,567,619 | B2 * | 10/2013 | Renz | A61J 9/04 215/11.4 |
| 2003/0024895 | A1 * | 2/2003 | Meyers | A61J 9/001 215/11.5 |
| 2003/0183595 | A1 * | 10/2003 | Huang | A61J 9/006 215/11.5 |
| 2004/0060888 | A1 | 4/2004 | Ahn | |
| 2007/0062904 | A1 * | 3/2007 | Beaudette | A61J 9/006 215/276 |
| 2011/0011819 | A1 * | 1/2011 | Lee | A61J 9/006 215/11.5 |
| 2014/0224758 | A1 * | 8/2014 | Wang | A61J 11/02 215/11.5 |

OTHER PUBLICATIONS

App No. PCT/US2016/015226 Written Opinion of the International Searching Authority, dated Apr. 11, 2016.
"Podee Baby Feeding System," www.amazon.com, May 8, 2008.

* cited by examiner

BABY BOTTLE ASSEMBLY INCLUDING A DIAPHRAGM THAT AUGMENTS A BABY'S ABILITY TO REMOVE LIQUID FROM A RECEPTACLE

CROSS-REFERENCE TO RELATED APPLICATIONS

This application is a nonprovisional of U.S. Provisional Patent Application No. 62/108,311, filed Jan. 27, 2015, which is hereby incorporated by reference herein in its entirety.

FIELD OF TECHNOLOGY

This invention relates to baby feeding equipment. More specifically, this invention relates to baby bottles.

BACKGROUND OF THE DISCLOSURE

Conventional baby bottles are well known. Conventional baby bottles typically include three parts: a receptacle, a nipple/gasket and a locking ring.

Typically, the receptacle is filled with liquid such as a baby formula or other suitable liquid. The locking ring is secured to the receptacle in such a way as to hold the nipple/gasket in place. The nipple/gasket is trapped between the locking ring and the receptacle. Specifically, the gasket portion of the nipple/gasket prevents liquid from leaking out of the baby bottle. The baby sucks from the nipple portion of the nipple/gasket.

Typically, conventional baby bottle construction requires close proximity between the baby and the receptacle because of the relatively short length of the nipple.

Certain circumstances, including but not limited to when the baby is being treated for certain medical conditions that require the baby to be placed in a controlled environment such as an incubator in the neonatal intensive care unit ("NICU") of a health care facility or in a bili-rubin light chamber for reducing the bili-rubin count of a child using phototherapy, may preclude close proximity of the baby to the receptacle. In such circumstances, the baby may have to be removed from the therapeutic controlled environment for extended periods in order to be fed. Removing the baby from the controlled environment reduces the effectiveness of the controlled environment on the baby's care.

Other circumstances where it may be beneficial to distance the receptacle from the baby include feeding the baby in a car seat or stroller. When the baby is positioned in a car seat or stroller it may be difficult for an adult supervising the baby to hold the receptacle in close proximity to the baby.

Additionally, typical baby bottles require that the receptacle holding liquid be positioned at a higher gravitational potential than a nipple of the bottle. Orienting the bottle in such a position typically requires that the baby be fed in a lying/leaning position or that the baby's head be tilted backward. Typical baby bottles do not allow a baby to access liquid in the receptacle when the baby is positioned in a sitting position and without tilting the baby's head. Feeding in an upright sitting position may reduce colic, gas, ear infection and reflux.

Attempts have been made to distance the nipple from the receptacle. For example, tubing may extend from inside the receptacle to a nipple.

However, such bottles typically require that the baby exert a greater sucking force to draw liquid from the receptacle than conventional bottles. Babies are typically easily able to draw liquids from conventional bottles. When babies are being fed from conventional bottles, the receptacle is typically positioned such that liquid stored in the receptacle is at a greater gravitational potential than the nipple. The liquid within the receptacle exerts pressure on the nipple when the nipple is at least partial inverted in the baby's mouth. The pressure exerted on the nipple allows the baby to easily draw the liquid out of the bottle.

When the nipple is separated (or separable) from the receptacle, the baby may be required to exert additional effort to draw liquid out of the receptacle to the nipple. The receptacle may be positioned such that the liquid does not exert pressure on the nipple when the nipple is in the baby's mouth. To draw liquid out of the receptacle, the baby may typically need to overcome a gravitational force and draw the liquid across a distance (e.g., through a length of tubing) before the liquid reaches the nipple. The gravitational force across the distance and/or altitude differential between the liquid and the baby may increase the force needed to draw liquid out of the bottle.

Additionally, when the nipple is separated (or separable) from the receptacle, a vacuum-like force may develop in a typical leak-proof receptacle as a result of the baby drawing fluid out of the receptacle. The vacuum-like force may hinder or prevent the baby's ability to draw fluid out of the receptacle to a distant nipple.

Another issue that arises with bottles that include a nipple that is separated (or separable) from the receptacle is an increase in a volume of air that is sucked up by a baby. Air is sucked up by the baby to initially draw liquid from the receptacle through the tubing and out of the nipple. Furthermore, after the baby ceases sucking activity, the liquid drawn into the nipple or tubing linking the nipple and receptacle typically recedes back into the receptacle. When the baby later renews sucking activity, the baby must draw additional air out of the tubing before liquid is again drawn up from the receptacle to the nipple.

Accordingly, it would be desirable to provide a bottle with an extended nipple that reduces an amount of effort required to draw fluid out of the receptacle to the nipple. It would be further desirable to provide a bottle with an extended nipple that augments the ability of the baby to draw the fluid from the receptacle. It would be further desirable to provide a bottle with an extended nipple that reduces the volume of air ingested by a baby when using a bottle with a separated (or separable) nipple.

SUMMARY

A baby bottle including a nipple, a tube, a receptacle and a bottle insert for mounting on the receptacle is provided. The insert may be joined to the nipple by the tube. The insert may include a plurality of apertures and a diaphragm for selectively covering the apertures. The diaphragm is preferably responsive to a change in pressure inside the receptacle. The pressure inside the receptacle may include air pressure, liquid pressure or any other suitable pressure. The sucking activity of a baby may cause the change in pressure. The diaphragm, in a first state, is preferably configured to prevent liquid from leaking out of the receptacle via the apertures. In a second state, (e.g., when a baby sucks the nipple and removes liquid/air from the receptacle) the diaphragm is configured to uncover the plurality of apertures and allow air to replace the liquid/air that is removed from the receptacle by the sucking of the baby.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION OF THE DISCLOSURE

Apparatus and methods in accordance with the disclosure will be described in connection with illustrative embodiments. The embodiments show illustrative features of apparatus and methods in accordance with the principles of the disclosure. It will be understood that features shown in connection with one of the embodiments may be practiced in accordance with the principles of the disclosure along with features shown in connection with another of the embodiments.

Apparatus and methods described herein are illustrative. Apparatus and methods of the disclosure may involve some or all of the features of the illustrative apparatus and/or some or all of the steps of the illustrative methods. The steps of the methods may be performed in an order other than the order shown or described herein. Some embodiments may omit steps shown or described in connection with the illustrative methods. Some embodiments may include steps that are not shown or described in connection with the illustrative methods.

Illustrative embodiments will now be described with reference to the accompanying drawings, which form a part hereof. It is to be understood that other embodiments may be utilized and structural, functional and procedural modifications may be made without departing from the scope and spirit of the present invention.

Figure 1:
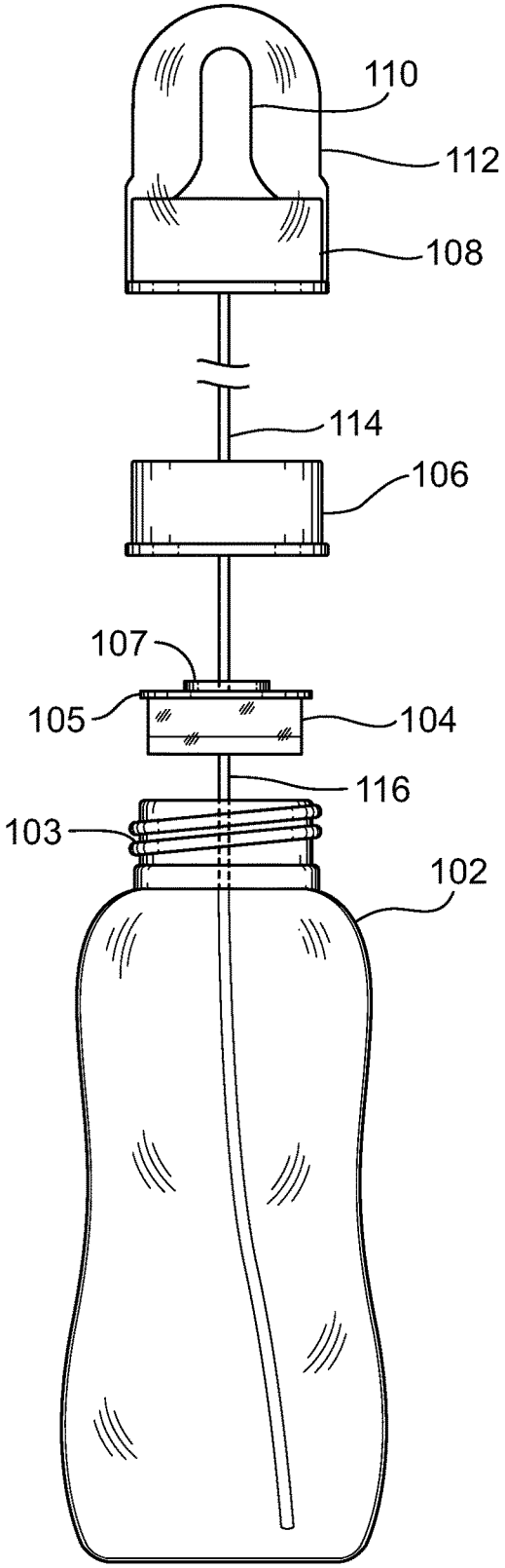
FIG. 1 shows a exploded side view of a baby bottle with an extended nipple according to certain embodiments.

FIG. 1 shows an exploded side view of a baby bottle assembly including an extended nipple according to certain embodiments of the invention. The baby bottle assembly includes receptacle 102. Receptacle 102 preferably stores a fluid. The liquid may be breast milk, formula, water, juice, or any other suitable fluid.

Receptacle 102 may include threaded neck 103. Threaded neck 103 may be externally threaded. Receptacle 102 may include a mouth. The mouth may be circular. The mouth may have a circumference. The mouth may be any suitable shape. The mouth may be used to access an inner surface of receptacle 102 to pour liquid into receptacle 102 or clean receptacle 102.

Threaded neck 103 may include a top surface. Threaded neck 103 may define the mouth of receptacle 102. The mouth may be defined by a cylindrical unthreaded surface of threaded neck 103.

The baby bottle assembly may also include insert 104. Insert 104 may be referred to alternately herein as a bottle insert. Insert 104 may include lip 105. Lip 105 may be referred to alternately herein as a flange. Lip 105 may have an outer circumference greater than or equal to the circumference of the mouth of receptacle 102. Lip 105 may have a diameter that is greater than a diameter of the mouth of receptacle 102. Lip 105 preferably positions insert 104 with respect to receptacle 102.

Insert 104 may be configured to fit on top of the mouth of receptacle 102. Insert 104 be configured to fit within the mouth of receptacle 102. In certain embodiments, lip 105 of insert 104 may rest on an edge of the mouth of receptacle 102. Insert 104 may fit snugly over and/or within the mouth of receptacle 102 by virtue of a friction fit.

The baby bottle assembly may include locking ring 106. Locking ring 106 may be preferably configured to fit over insert 104 and screw onto threaded neck 103.

For example, in some embodiments, locking ring 106 may be internally threaded. In some embodiments, locking ring 106 may include an internally threaded neck. The threads of locking ring 106 may be configured to mate with threaded neck 103. When locking ring 106 is secured to receptacle 102—e.g., by screwing locking ring 106 onto threads 103—lip 105 of insert 104 may preferably be held in a position relative to the mouth of receptacle 102. Securing lip 105 onto the mouth of the receptacle may secure insert 104 between locking ring 106 and receptacle 102. In some embodiments, the mating of locking ring 106 with threaded neck 103 may secure insert 104 against the neck of receptacle 102.

Figure 3:
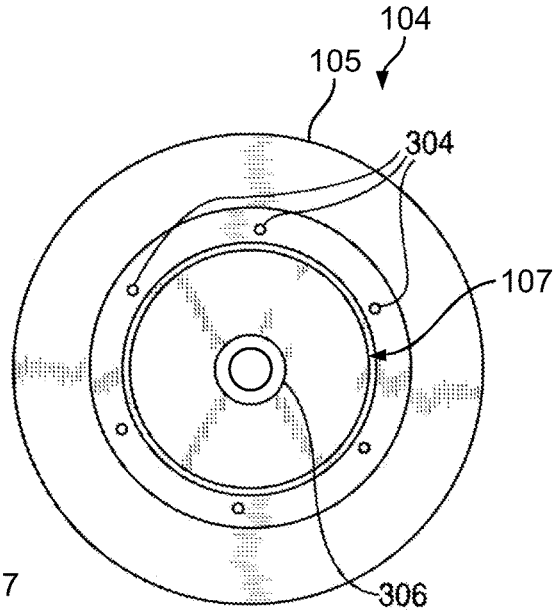
FIG. 3 shows a top plan view of a bottle insert covered by a locking ring according to some embodiments.

When locking ring 106 is engaged with receptacle 102, inner raised portion 107 of insert 104 may not be covered by locking ring 106 (as shown in greater detail in FIG. 3). Inner raised portion 107 may be a cylindrical protrusion or a protrusion of any other suitable shape. Inner raised portion 107 may include one or more grooves, ridges or other suitable features/designs. Additional features of insert 104, such as apertures and/or a hollow projection, may also not be covered by locking ring 106 (as shown in greater detail in FIG. 3).

The baby bottle assembly may include nipple 110. Nipple 110 may preferably help to simulate the nursing experience. When the nipple is not in use, nipple 110 may be covered with bottle cap 112 to maintain hygiene of nipple 110. Bottle cap 112 may preferably engage collar 108. Bottle cap 112 may prevent fluid leakage.

The baby bottle assembly may also include collar 108. Collar 108 may be internally threaded. Collar 108 may be configured to receive a bottom portion of nipple 110. Nipple 110 may attach to collar 108 by a friction fit. Nipple 110 may include a groove. A portion of collar 108 may be held within the groove. In some embodiments, collar 108 may seal tube 114 to nipple 110.

Figure 14:
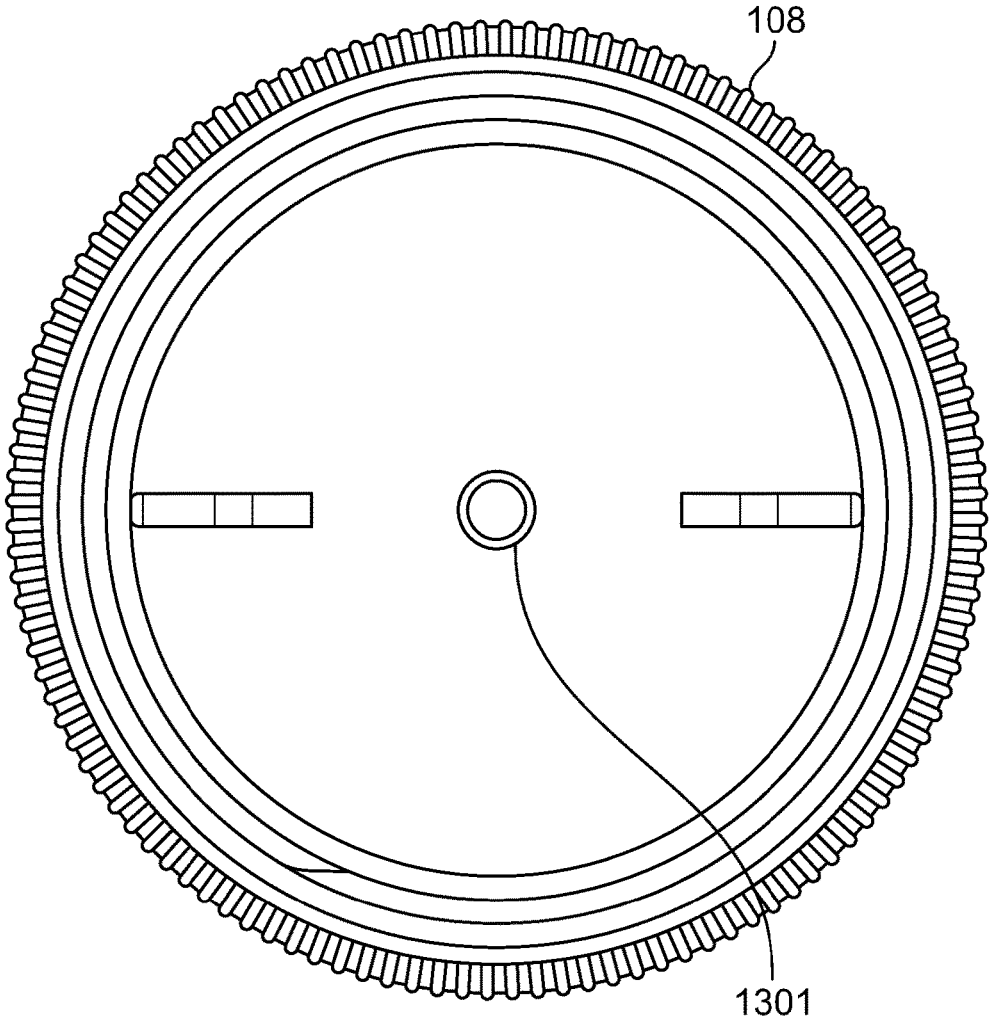
FIG. 14 shows a bottom plan view of a collar and collar insert.

Collar 108 may be configured to mate with an externally threaded collar insert (as shown in greater detail in FIG. 14). Collar 108 may also be configured to mate with externally threaded neck 103.

In some embodiments, the baby bottle assembly may include tubes 114 and 116.

Figure 13A:
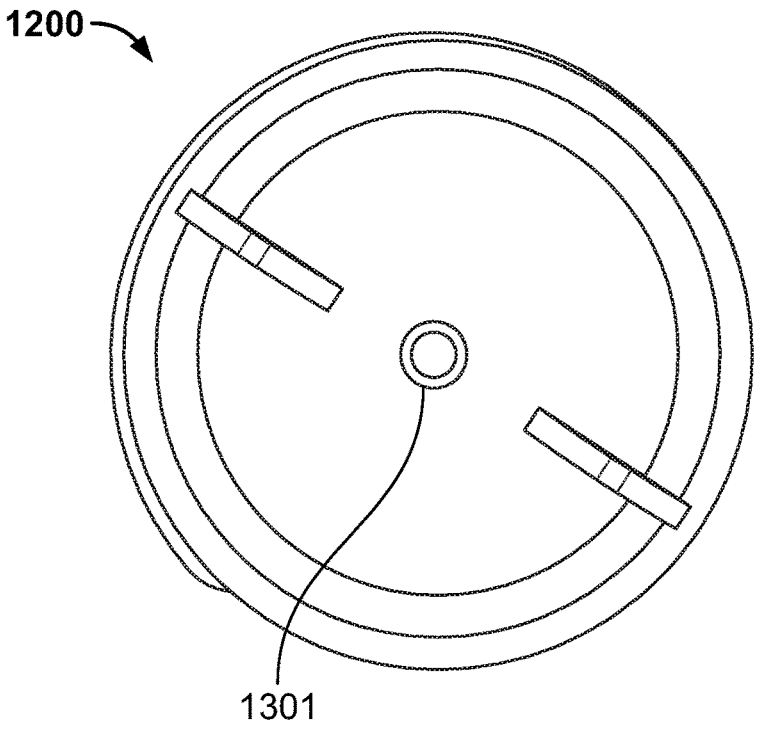
FIG. 13A shows a bottom plan view of a collar insert.

A first end of tube 114 may couple to a hollow protrusion extending away from a collar insert (as shown in greater detail in FIG. 13A). The collar insert may be configured to be coupled to collar 108. The hollow protrusion may be a hollow cylindrical protrusion. The first end of tube 114 may be removably coupled to the hollow protrusion by friction fit. The friction fit may create an air-tight and water-tight seal.

A second end of tube 114 may be coupled to a top hollow protrusion extending away from a top of insert 104 (as shown in greater detail in FIG. 3). The top hollow protrusion may be a hollow cylindrical protrusion. The second end of tube 114 may be removably coupled to the top hollow protrusion of insert 104 by friction fit. The friction fit may create an air-tight and water-tight seal.

A first end of tube 116 may couple to a hollow protrusion that extends from a bottom of insert 104. The hollow protrusion on the bottom of insert 104 may extend away from a bottom surface of bottle insert 104 (as shown in greater detail in FIG. 4). The bottom hollow protrusion may be a cylindrical hollow protrusion. The first end of tube 116 may be removably coupled to the end of the bottom hollow protrusion by a friction fit. The friction fit may create an air-tight and water-tight seal.

In some embodiments, insert 104 may include one hollow protrusion that extends away from the top of insert 104, through a center of insert 104 and away from a bottom of insert 104.

A second end of tube 116 may lie at or near a bottom surface of receptacle 102.

In these embodiments, a baby sucking on nipple 110 may draw air or liquid through tube 114, which in turn draws air or liquid through tube 116, which in turn draws air or liquid out of receptacle 102, decreasing the air pressure in receptacle 102.

In other embodiments, tube 114 and tube 116 may be unitary. In these embodiments, the tube, which is shown in only partial length, may couple receptacle 102, insert 104 and locking ring 106, collectively hereinafter, the "receptacle assembly", to nipple 110. In these embodiments, the tube may pass through insert 104 and into receptacle 102. In these embodiments, the tube may form a friction fit as it passes through insert 104. The friction fit may prevent fluid from exiting the receptacle between the outside of the tube and insert 104.

Figure 2:
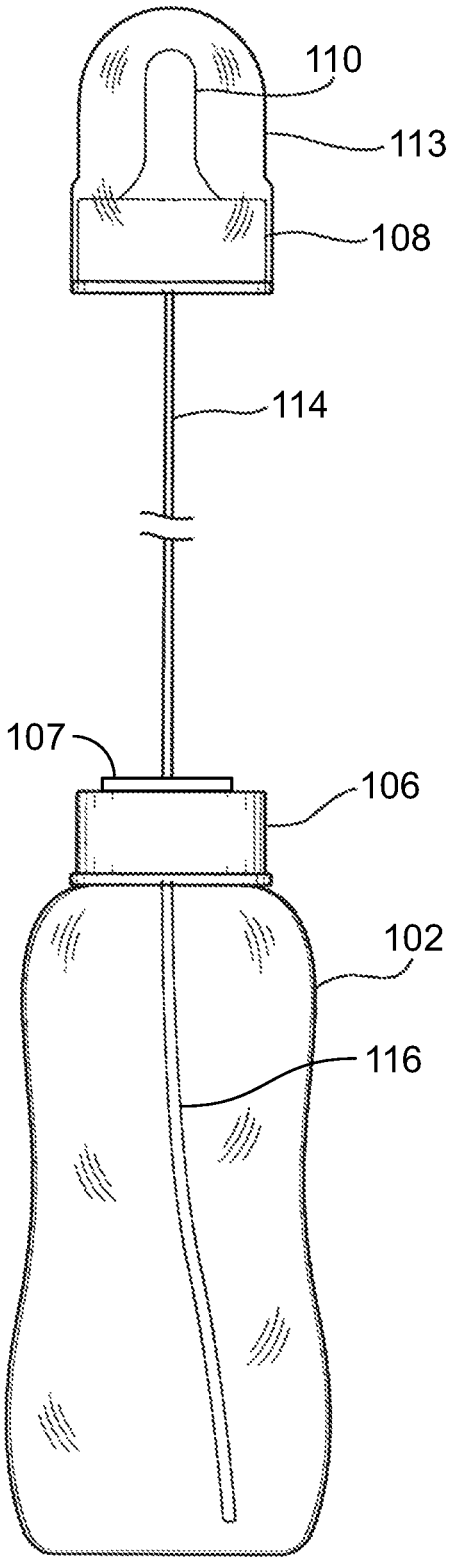
FIG. 2 shows a side view of a baby bottle with an extended nipple according to certain embodiments.

FIG. 2 shows a side view of a baby bottle assembly with an extended nipple according to certain embodiments. In FIG. 2, the receptacle assembly is fully engaged, with locking ring 106 in place over receptacle 102. Insert 104 (shown in FIG. 1) is trapped in between receptacle 102 and locking ring 106. Inner raised portion 107 of insert 104 is shown, projecting above locking ring 106.

FIG. 3 shows a top plan view of bottle insert 104. The top plan view of bottle insert 104 shows lip 105, inner raised portion 107, apertures 304 (explained in more detail with respect to FIG. 4 below) and a hollow protrusion 306. Hollow protrusion 306 may be a hollow cylindrical protrusion or any other shaped protrusion.

It should be noted that, in FIG. 3, a top of hollow protrusion 306 is visible. Hollow protrusion 306 may include a top portion and a bottom portion. The top portion may extend away from a top surface of bottle insert 104 (illustrated in FIG. 3). The bottom portion may extend away from a bottom surface of bottle insert 104 (illustrated in FIG. 5).

In some embodiments, bottle insert 104 may not include inner raised portion 107. In some embodiments, an inner raised portion may separate apertures 304 from hollow protrusion 306, but may not extend above lip 105.

Hollow protrusion 306 may receive and engage tube 114. For example, hollow protrusion 306 may hold an end of tube 114 in place by friction fit.

In other embodiments, reference number 306 may represent a hole. Reference number 306 may represent a hole in the embodiments in which tubes 114 and 116 are of unitary construction. Bottle insert 104 may fix the tube in place about the hole by an adhesive attachment, friction fit or any other suitable mechanical attachment. The attachment may be permanent. The attachment may include a releasable mechanism. In these embodiments, a portion of an outer surface of the tube may be affixed to insert 104 such that substantially no leakage occurs at an interface between an outer surface of the tube and an inner edge of the hole.

Figure 4:
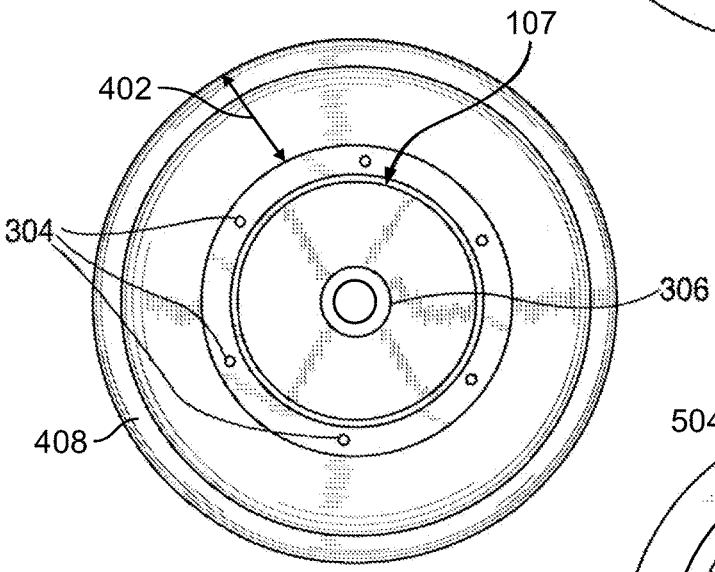
FIG. 4 shows a top plan view of a bottle insert according to some embodiments.

FIG. 4 shows a top plan view of locking ring 106 coupled to bottle insert 104. In some embodiments, locking ring 106 may be coupled to bottle insert 104 as follows: lip 105 of bottle insert 104 may be placed over the mouth of receptacle 102. Locking ring 106 may then be screwed onto threaded neck 103, securing bottle insert 104 between locking ring 106 and threaded neck 103.

In FIG. 4, lip 105 of bottle insert 104 is covered by locking ring 106. Top surface 402 of locking ring 106 is illustrated as covering a portion of bottle insert 104. In some embodiments, the portion of bottle insert 104 covered by locking ring 106 may include some or all of lip 105.

Locking ring 106 does not cover apertures 304, inner raised portion 107 or a top portion of hollow protrusion 306.

In some embodiments, apertures 304 may be circumferentially distributed around hollow protrusion 306. In some embodiments, apertures 304 may be distributed in any suitable arrangement on insert 104. Apertures 304 may have a circular, oval, square, triangular or any suitable shape. Apertures 304 may be positioned on a surface of insert 104 that lies below lip 105.

As will be explained in more detail below, apertures 304 preferably allow for the introduction of air into the receptacle in response to a drop in air pressure in receptacle 102. The decrease in air pressure in receptacle 102 may be created when a baby sucks from nipple 110.

FIG. 4 also illustrates lip 408 of locking ring 106. Lip 408 of locking ring 106 may securely hold bottle cap 112 when bottle cap 112 is pressed down onto lip 408.

As described above, locking ring 106 may be coupled to receptacle 102 with bottle insert 104 positioned between locking ring 106 and the mouth of receptacle 102. In some embodiments, locking ring 106 can alternatively be used to secure a nipple such as nipple 110 to receptacle 102. For example, nipple 110 may fit securely into locking ring 106 by a friction fit. After coupling nipple 110 to locking ring 106, locking ring 106 may be screwed onto threaded neck 103, holding nipple 110 in place and creating a water-tight seal to prevent any leakage from the bottle.

In some embodiments, locking ring 106 and collar 108 may be substantially identical. In some embodiments, locking ring 106 and collar 108 may be identical.

Figure 5:
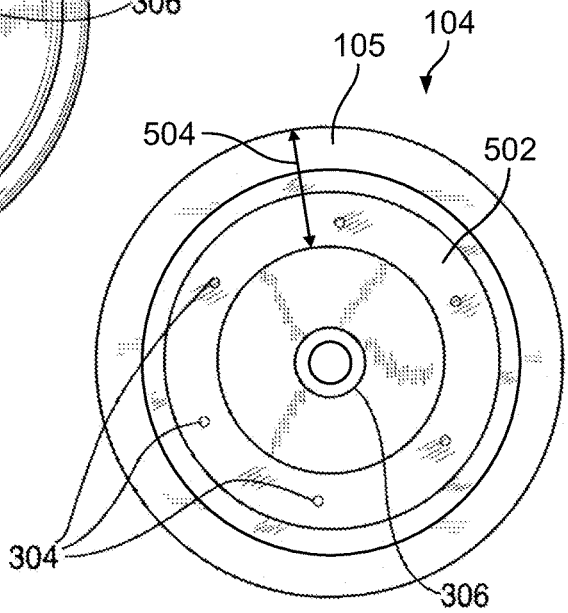
FIG. 5 shows a bottom plan view of a bottle insert according to some embodiments.

FIG. 5 shows a bottom plan view of bottle insert 104. The bottom plan view may illustrate a bottom surface of bottle insert 104. The bottom surface of bottle insert 104 may include a bottom surface of lip 105. The bottom surface may also include apertures 304 and a bottom portion of hollow protrusion 306. The bottom portion of hollow protrusion 306 may be cylindrical. The bottom portion of hollow protrusion 306 may be a different shape from a top portion of the protrusion.

FIG. 5 also illustrates diaphragm 502. Diaphragm 502 may be coupled to the bottom surface of bottle insert 104. When diaphragm 502 is coupled to the bottom surface, diaphragm 502 may cover a portion of the bottom surface. For example, diaphragm 502 may extend over an area of the bottom surface shown by arrow 504. Diaphragm 502 may adhere to insert 104 by friction fit.

Diaphragm 502 may be formed from any suitable substance. For example, diaphragm 502 may be formed from silicon, rubber or any other suitable pliable material. Diaphragm 502 may have a varying thickness. For example, inner flap 501 of diaphragm 502 that covers apertures 304 may be thinner relative to a portion of diaphragm 502 that covers lip 105. Diaphragm 502 may be formed from two or more materials.

Inner flap 501 of diaphragm 502 may be bendable under application of pressure. Inner flap 501, while bendable under pressure, may be formed from a sufficiently thick layer of silicone or other suitable material so as to remain in place over apertures 304 in preferably all foreseeable rest state conditions. In some embodiments, in a rest state, inner flap 501 may be biased to cover apertures 304.

When diaphragm 502 covers apertures 304, apertures 304 may be fluidly sealed by the diaphragm. For example, when diaphragm 502 is in a rest state, diaphragm 502 may fluidly seal apertures 304. When apertures 304 are fluidly sealed by diaphragm 502, receptacle 102 may be turned upside down without liquid escaping. As a result, embodiments described herein may be less likely to leak liquid.

Diaphragm 502 may be permanently or removably secured at its outer end to bottle insert 104, but free about an edge of inner flap 501. For example, in some embodiments, diaphragm 502 may be secured to bottle insert 104 at its outer end by glue, friction fit, supersonic welding or any other suitable form of mechanical attachment. In some embodiments, diaphragm 502 may be removably secured to bottle insert 104 at its outer edge through friction fit or as a result of being trapped between insert 104 and receptacle 102. Locking ring 106, when screwed on to threaded neck 103 may trap diaphragm 502 between insert 104 and receptacle 102. When trapped between insert 104 and receptacle 102, diaphragm 502 may provide a fluid tight seal between insert 104 and receptacle 102.

In some embodiments, diaphragm 502 may provide a valve. The valve may function as a uni-directional valve. During a pressure equilibrium state—e.g., when a baby is not sucking on nipple 110—(alternatively referred to herein as a "rest state") inner flap 501 of diaphragm 502 may cover apertures 304 and prevent liquid in receptacle from leaking through apertures 304. During an active state, when the baby is sucking on nipple 110, a decrease in pressure within receptacle 102 may pull down inner flap 501 of diaphragm 502, unsealing inner flap 501 from apertures 304. Unsealing apertures 304 may enable air to flow from outside the bottle, through apertures 304 and into receptacle 102. A flow of air into receptacle 102 may prevent liquid from leaking out of receptacle 102 when apertures 304 are unsealed.

The introduction of air into receptacle 102 may prevent the baby from being inhibited by a vacuum-like force that may develop in a typical leak-proof receptacle as a result of drawing liquid out of the receptacle. The introduction of air into receptacle 102 may allow the baby to more easily draw liquid out of receptacle 102. The introduction of air into receptacle 102 may allow a baby to continuously draw liquid out of receptacle 102.

Apertures 304 may allow for the introduction of air to the receptacle when diaphragm 502 unseals apertures 304 in response to a drop in pressure in receptacle 102. The decrease in pressure in receptacle 102 may be generated by a baby sucking on nipple 110.

Air flow through apertures 304 and into receptacle 102 may equalize pressure, or partially equalize pressure, inside receptacle 102. For the purposes of this application, 'equalization of the pressure' may refer to returning the air pressure inside receptacle 102 to a pressure value that was present before a baby started sucking on nipple 110.

Equalization of pressure, or partial equalization of pressure, may allow the diaphragm to return to a biased position of covering apertures 304. Apertures 304 may be uncovered or open during a first portion of the baby's sucking cycle. Apertures 304 may be covered during a second portion of a baby's sucking cycle. The first portion of the sucking cycle may correspond to when the baby is actively sucking on nipple 110. The second portion of the sucking cycle may correspond to when the baby is not actively sucking on nipple 110.

Covering and uncovering apertures 304 may reduce pressure variability within receptacle 102 during the baby's sucking cycle by maintaining the pressure in receptacle 102 within a pre-determined window for at least a portion of the sucking cycle. Reducing pressure variability may allow liquid previously drawn into tubing 114 and/or 116 during a first portion of the sucking cycle to remain substantially inside tubing 114 and/or 116 during a second portion of the sucking cycle. After a baby stops actively sucking on nipple 110, liquid may remain inside tubing 116 and 114. When the baby renews sucking activity, the baby may draw a minimal amount of air before drawing liquid out of nipple 110.

Furthermore, the introduction of air through apertures 304 may allow the baby to continuously draw liquid out of receptacle 102. The baby may continuously draw liquid out of receptacle 102 without pausing to allow air to enter receptacle 102 via a nipple. As a result of the baby being able to continuously draw liquid out of receptacle 102, the liquid within tubing 114 may be prevented from seeping back into receptacle 102 when the baby would have had to pause sucking to allow air to enter via a nipple. This may augment a baby's ability to draw liquid from receptacle 102 using relatively longer lengths of tubing 114 (as compared to a traditional baby bottle).

In certain embodiments, a siphon effect may be created when apertures 304 are open. The siphon effect may further augment the baby's ability to draw-up the liquid. Because the liquid in receptacle 102 is at a distance from the baby, an additional sucking force is typically required to draw the liquid from the receptacle to the baby.

For example, when the baby is at a lower gravitational potential than liquid in receptacle 102, the baby's sucking may cause the liquid to begin to flow from receptacle 103 to nipple 110. The flow, which is initiated by the pressure created by the baby's sucking, may be augmented because gravitational potential energy at the elevation of the liquid is greater than gravitational potential energy at the elevation of the baby. Nevertheless, the liquid does not continue to flow after the baby stops sucking because, although the gravitational potential energy at the elevation of the liquid is greater than gravitational potential energy at the elevation of the baby, the gravitational potential energy differential is not sufficient to maintain the nipple in an open state (or to open the nipple) and cause liquid to flow absent the baby sucking. Accordingly, certain embodiments may preferably only augment the baby's sucking but do not cause unwanted liquid to leak from the baby's bottle.

In some embodiments, an enhanced flow effect may be triggered even when the receptacle is at a lower gravitational potential energy than the baby. Suction of the baby may aid in initiating the flow of fluid out of the nipple. Furthermore, suction of the baby may unseal apertures 304 which may in turn enhance the flow of fluid from the receptacle to the nipple.

Illustrative usage of the apparatus and methods disclosed herein may be described as follows.

Securing locking ring 106 to receptacle 102, with bottle insert 104 and diaphragm 502 therebetween, fluidly seals the system. In some embodiments, fluid may exit through nipple 110. Nipple 110 allows liquid to be sucked from receptacle 102 via tube 116, hollow protrusion 306 and tube 114. In certain embodiments, apertures 304 may allow fluid to enter/escape the system when diaphragm 502 unseals the apertures. For example, when a baby sucks of nipple 110, diaphragm 502 may be configured to unseal apertures 304 and allow air to replace liquid removed by the baby from receptacle 102 through nipple 110. It should be noted that, in operation, the flow of fluid through nipple 110 is preferably substantially uni-directional into the baby's mouth and the flow of air through apertures 304 is preferably uni-directional from the environment into receptacle 102. The fluid exchange in the bottle operates as follows.

When the baby begins to suck on nipple 110, an area of low pressure is created within receptacle 102. The low pressure pulls the inner flap 501 of diaphragm 502 down into receptacle 102.

When inner flap 501 of diaphragm 502 is sufficiently pulled down into receptacle 102 as a result of low pressure generated by the baby sucking fluid our of nipple 110, apertures 304 allow air to pass into receptacle 102, thereby counteracting the drop in pressure created by the baby's sucking on nipple 110. Once the drop in pressure in receptacle 102 is counteracted by the introduction of air through apertures 304 and pressure equilibrium is reestablished within receptacle 102, diaphragm 502 preferably returns to a rest state—i.e., covering apertures 304. It should be noted that, in some embodiments, apertures 304 may remain open as long as the baby continues to suck on nipple 110.

Figure 6:
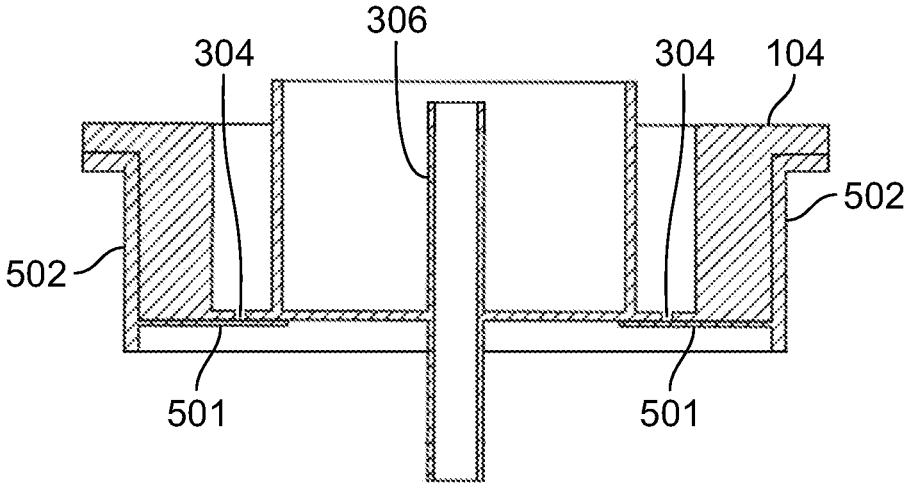
FIG. 6 shows a cut-away side view of a bottle insert with a diaphragm in a closed state according to some embodiments.
Figure 7:
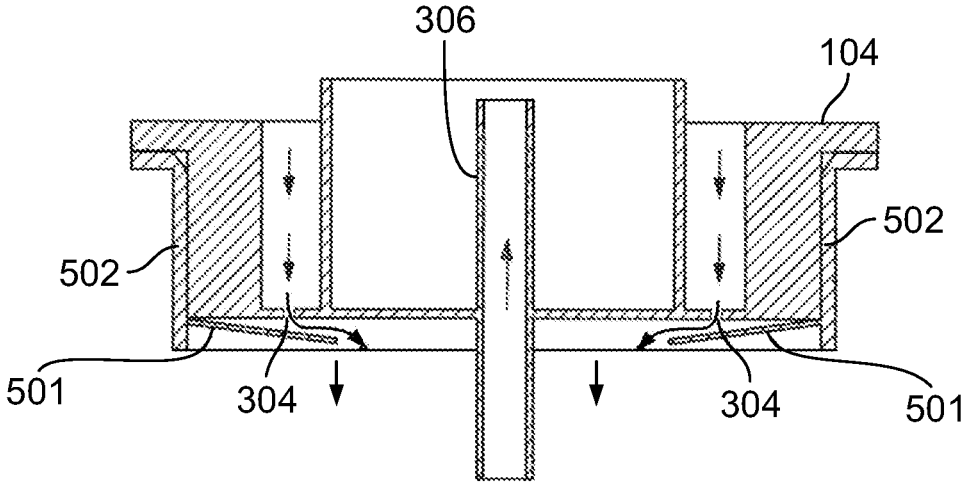
FIG. 7 shows a cut-away side view of a bottle insert with the diaphragm in an open state according to some embodiments.

FIGS. 6 and 7 illustrate the operation of diaphragm 502 within bottle insert 104.

FIG. 6 shows a cut-away side view of bottle insert 104 with diaphragm 502 coupled to bottle insert 104. In FIG. 6, the pressure within receptacle 102 is in an equilibrium state and, as a result, diaphragm 502 is in a sealed state.

When diaphragm 502 is in a sealed state, inner flap 501 of diaphragm 502 fluidly seals apertures 304. Sealing apertures 304 may prevent apertures 304 from allowing liquid to leak out of receptacle 102. Sealing apertures 304 may also prevent liquid drawn by a baby into one or both of tubes 114 and 116 from receding back into receptacle 102 when the baby stops sucking. Preventing liquid from receding back into receptacle between periods of sucking activity may reduce an amount of air drawn by a baby when the baby renews sucking activity.

FIG. 7 shows a cut-away side view of bottle insert 104 and diaphragm 502 when a baby has begun to suck on nipple 110. Sucking on nipple 110 draws liquid up through tube 116, through hollow protrusion 106, and through tube 114 (flow shown schematically with an arrow), thereby decreasing air pressure within receptacle 102.

Lowering air pressure within receptacle 102 may pull diaphragm 502 away from apertures 304 which, in turn, unseals apertures 304 and allows air to be drawn through apertures 304. When air flows, via apertures 304, into receptacle 102, the air pressure within receptacle 102 preferably returns to equilibrium prior to the next sucking action by the baby. An equilibrium state may be defined by a state of the system before an initial sucking action of the baby.

It should be noted that repeated sucking actions by the baby may not fully allow the pressure within the receptacle to return to an equilibrium state. However, in such circumstances, the pressure within receptacle 102 may rise and fall sufficiently such that diaphragm 502 opens and closes, or simply remains open, in response to the baby's repeated sucking actions. The opening of diaphragm 502 preferably augments the baby's ability to suck liquid out of receptacle 102.

Additionally, selectively unsealing apertures 304 in response to sucking activity may augment a baby's ability to draw liquid from receptacle 102 using relatively longer lengths of tubing 114 and/or tubing 116.

Figure 8:
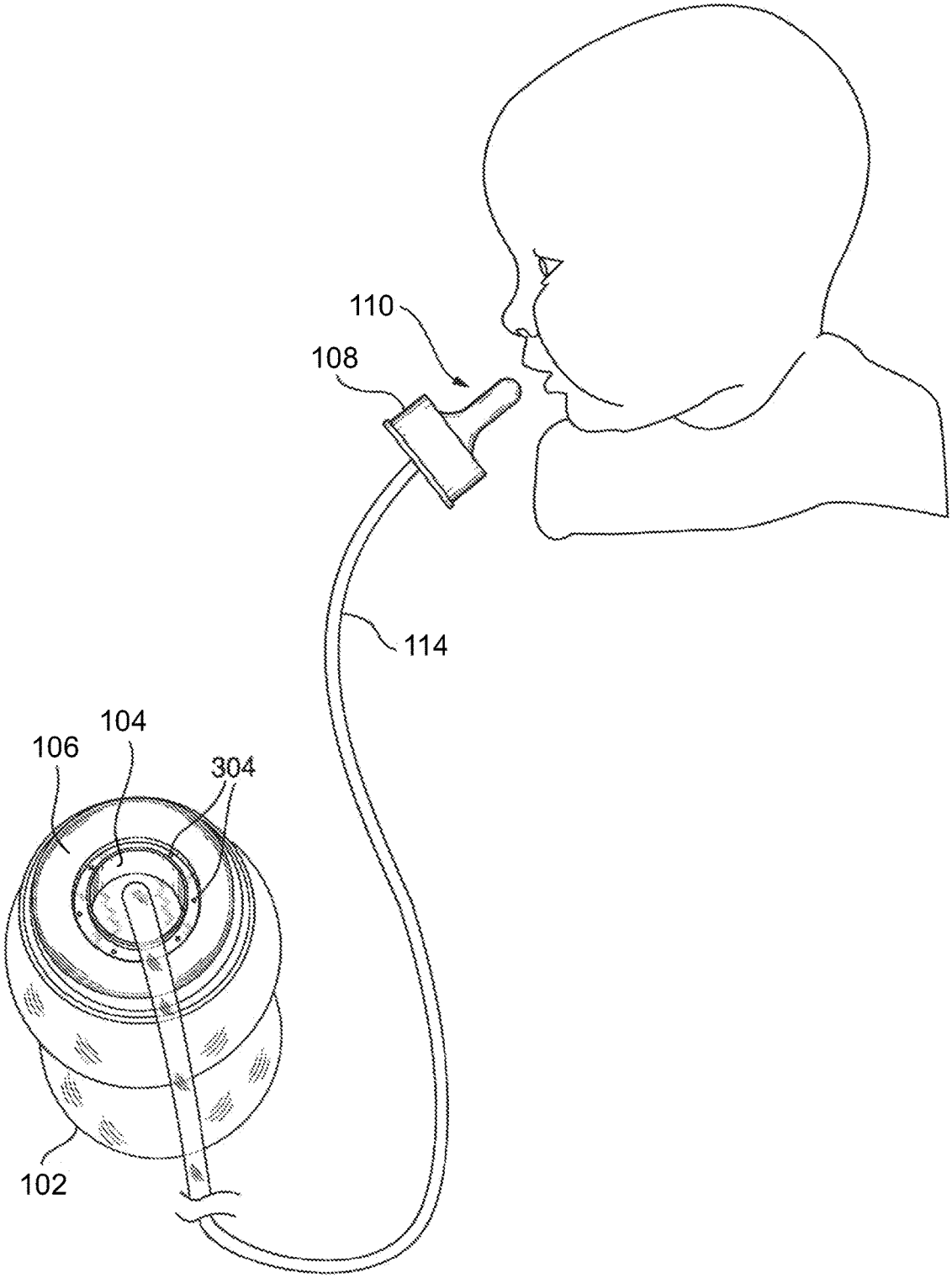
FIG. 8 shows a perspective view of a baby bottle according to some embodiments.

FIG. 8 shows a perspective view of a baby bottle according to some embodiments. FIG. 8 shows receptacle 102, bottle insert 104, apertures 304, locking ring 106, tube 114, collar 108 and nipple 110. FIG. 8 shows the system at a rest or equilibrium state as the baby is not sucking on nipple 110.

Figure 9:
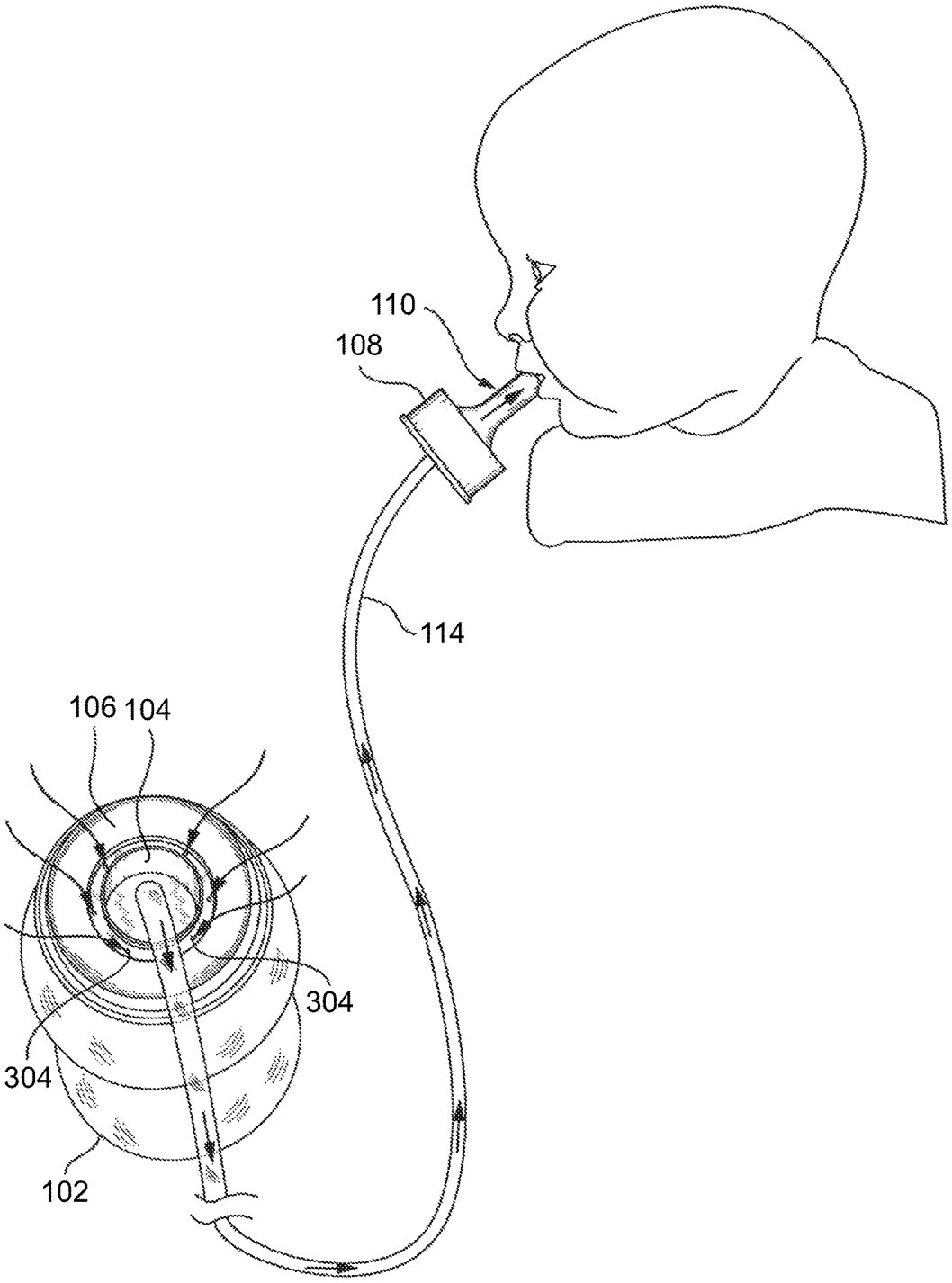
FIG. 9 shows another perspective view of a baby bottle with flow indicators according to some embodiments.

FIG. 9 shows another perspective view of a baby bottle with fluid flow indicators according to some embodiments. FIG. 9 shows the baby sucking on nipple 110. FIG. 9 also shows, schematically, the effect of the baby's sucking.

First, pressure builds up at nipple 110. Sucking at nipple 110 causes low pressure to be created within receptacle 102. The low pressure within receptacle 102 may open diaphragm 502 and draw air through apertures 304.

In some embodiments, the drawing of liquid through tube 114 may augment the baby's sucking of liquid through operation of the siphon effect. It should be noted that, in order to efficiently take advantage of the siphon effect that can occur exists when the bottle is at an elevation that is higher than the baby, the hole(s) in nipple 110 should be sufficiently large to allow liquid to pass when sucked and be augmented by the siphon effect. It should further be noted that the hole(s) in nipple 110 may be sufficiently small, and resistant to passing liquid, such that in order to stop the liquid from continuing to pass through the nipple 110 after the baby has stopped sucking the nipple 110 should close (or remain closed) when the baby is not sucking.

Figure 10:
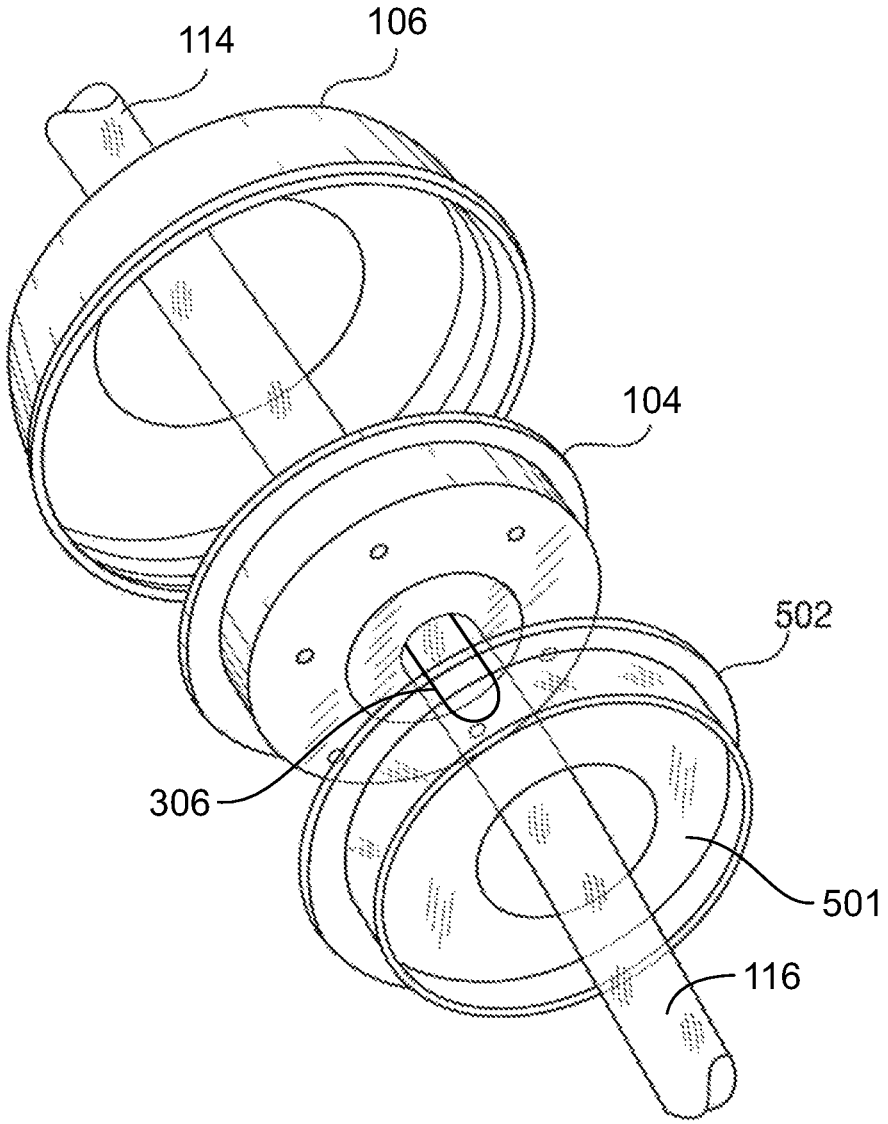
FIG. 10 shows an exploded view of illustrative components of a baby bottle.

FIG. 10 shows an exploded view of illustrative components including locking ring 106, insert 104 and diaphragm 502 according to certain embodiments. FIG. 10 also shows tubes 114 and 116, in addition to a bottom portion of hollow protrusion 306.

In embodiments wherein tubes 114 and 116 are of unitary construction, and hollow protrusion 306 may not be included in insert 104. A single tube may run through the center of insert 104 assembly and fluidly link receptacle 102 to nipple 110.

Figure 11:
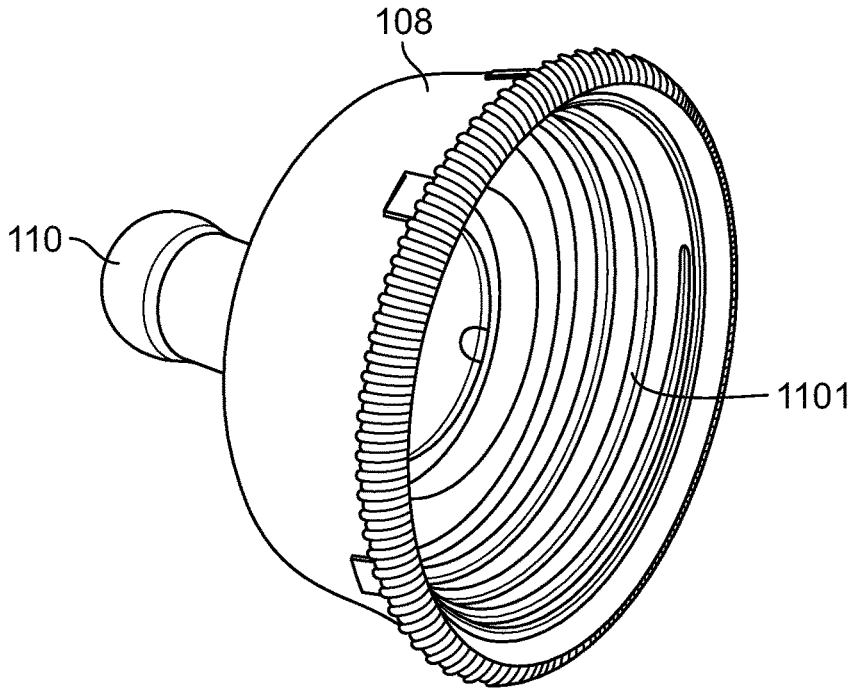
FIG. 11 shows a perspective view of a nipple and collar.

FIG. 11 shows a perspective view of nipple 110 seated within collar 108. FIG. 11 also illustrates collar 108's internally threaded surface 1101. Threaded surface 1101 may be configured to threadedly engage threaded neck 103 (shown in FIG. 1).

Figure 12:
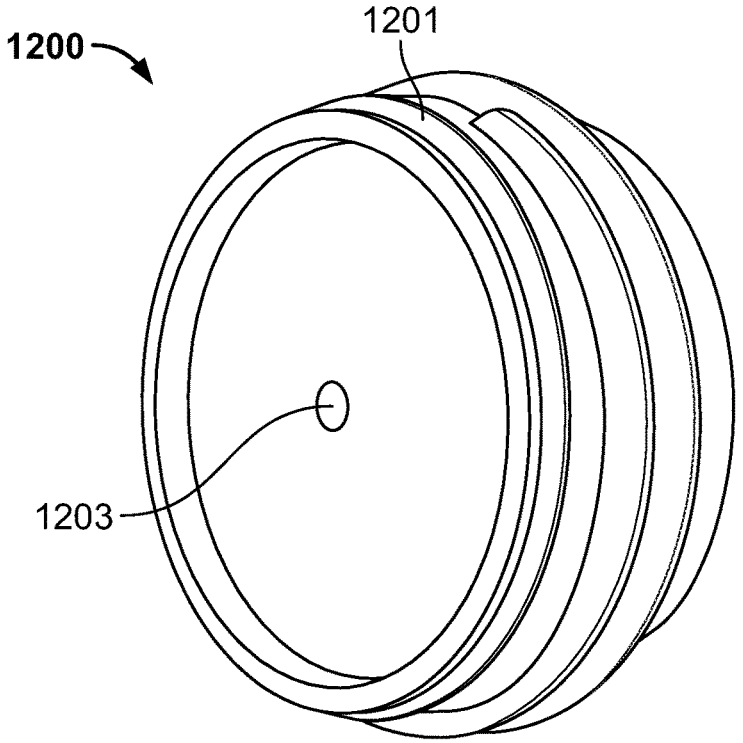
FIG. 12 shows a perspective view of a collar insert.

FIG. 12 shows a perspective view of collar insert 1200. Collar insert 1200 may include externally threaded surface 1201. Externally threaded surface 1201 may mate with internally threaded surface 1101 of collar 108.

Collar insert 1200 may include opening 1203. Opening 1203 may allow fluid to flow through collar insert 1200. In some embodiments, opening 1203 may allow air to flow through collar insert 1200 and hollow protrusion 1301 (shown in FIGS. 13A and 13B).

FIG. 13A shows a bottom view of collar insert 1200. The view illustrated in FIG. 13A includes hollow protrusion 1301. Hollow protrusion 1301 may be a cylindrical hollow protrusion. Hollow protrusion 1301 may extend away from a bottom surface of collar insert 1200.

Figure 13B:
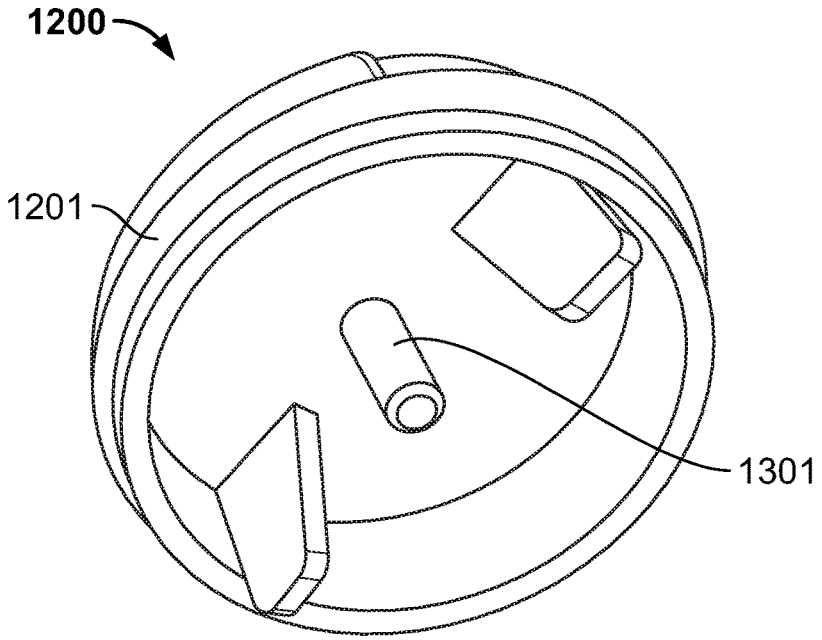
FIG. 13B shows a perspective view of a collar insert.

FIG. 13B shows a perspective view of a bottom surface of collar insert 1200.

FIG. 14 shows a bottom view of collar insert 1200 screwed into collar 108.

An exemplary baby bottle assembly may include the following: nipple 110 may be seated within collar 108. Collar insert 1200 may be screwed into collar 108. A first end of tube 114 may be attached to hollow protrusion 1301 extending away from collar insert 1200. A second end of tube 114 may be attached to a top portion of hollow protrusion 306.

An end of tube 116 may be attached to a bottom portion of hollow protrusion 306. Insert 104 may be positioned on the mouth of receptacle 102. Locking ring 106 may be screwed onto threaded neck 103 of receptacle 102, thereby securing insert 104 between receptacle 102 and locking ring 106.

A baby may subsequently suck on nipple 110. Sucking on nipple 110 may draw air and/or liquid out of receptacle 102, through tube 116, through hollow protrusion 306, through tube 114, through hollow protrusion 1301, through opening 1203, into nipple 110 and into the baby's mouth.

Thus, various embodiments of apparatus for a baby bottle assembly with an extended nipple are presented. Persons skilled in the art will appreciate that the present invention can be practiced by other than the described embodiments, which are presented for purposes of illustration rather than of limitation, and that the present invention is limited only by the claims that follow.

What is claimed is:

1. A baby bottle comprising:
a nipple seated within a collar;
a collar insert coupled to the collar;
a first length of tubing for transferring liquid from a bottle insert to the nipple, wherein a first end of the first length of tubing is coupled to the collar insert and a second end of the first length of tubing is coupled to the bottle insert;
a receptacle; and
a second length of tubing for transferring liquid from the receptacle to the bottle insert, wherein a first end of the second length of tubing is positioned within the receptacle and a second end of the second length of tubing is coupled to the bottle insert; wherein the bottle insert is configured to be positioned on the receptacle, said bottle insert comprising:
a plurality of apertures; and
a diaphragm coupled to the bottle insert for selectively sealing the apertures, wherein the diaphragm, in a first state corresponding to a pressure equilibrium state in the receptacle, is configured to prevent liquid from leaking out of the receptacle via the apertures, and, in a second state corresponding to a state of less pressure in the receptacle than the pressure equilibrium state, the diaphragm is configured to unseal the plurality of apertures and allow air to replace liquid that is removed from the receptacle via the nipple.

2. The baby bottle of claim 1 wherein the first state corresponds to a period of time when no liquid is being removed from the baby bottle via the nipple.

3. The baby bottle of claim 1 wherein the second state corresponds to a period of time when liquid is being removed from the receptacle via the nipple.

4. The baby bottle of claim 1 wherein the second end of the first length of tubing is coupled to the bottle insert by fitting the second end of the first length of tubing over a hollow protrusion extending away from a top surface of the bottle insert.

5. The baby bottle of claim 1 wherein:
the receptacle includes a mouth; and
the bottle insert includes a flange having a diameter equal to or greater than a diameter of the mouth.

6. A baby bottle assembly comprising:
a nipple;
a collar configured to receive a bottom portion of the nipple;
a collar insert configured to be coupled to the collar;
a receptacle comprising a mouth and a neck;
a bottle insert configured to be positioned on the receptacle, the bottle insert comprising a plurality of apertures;
a diaphragm configured to be coupled to the bottle insert, wherein in operation the diaphragm seals the apertures when the receptacle is in a pressure equilibrium state and unseals the apertures when the receptacle is at a state of less pressure than the pressure equilibrium state;
a first length of tubing that in operation transfers liquid from the bottle insert to the nipple via a first end of the first length of tubing coupled to the collar insert and a second end of the first length of tubing coupled to the bottle insert; and
a second length of tubing that in operation transfers liquid from the receptacle to the bottle insert via a first end of the second length of tubing positioned within the receptacle and a second end of the second length of tubing coupled to the bottle insert.

7. The baby bottle assembly of claim 6 wherein:
the bottle insert includes a first hollow protrusion; and
the collar insert includes a second hollow protrusion.

8. The baby bottle assembly of claim 7 wherein:
the first end of the first length of tubing is configured to be coupled to the second hollow protrusion; and
the second end of the first length of tubing is configured to be coupled to the first hollow protrusion.

9. The baby bottle assembly of claim 8 wherein the second end of the second length of tubing is configured to be coupled to the first hollow protrusion.

10. The baby bottle assembly of claim 6 wherein a baby sucking from the nipple removes air or liquid from the receptacle.

11. The baby bottle assembly of claim 8 wherein the second end of the first length of tubing is coupled to the first hollow protrusion by a friction fit that maintains a liquid tight seal between the second end of the first length of tubing and the first hollow protrusion.

12. The baby bottle assembly of claim 8 wherein the first end of the first length of tubing is coupled to the second hollow protrusion by a friction fit that maintains a liquid tight seal between the first end of the first length of tubing and the second hollow protrusion.

13. The baby bottle assembly of claim 9 wherein the second end of the second length of tubing is coupled to the first hollow protrusion by a friction fit that maintains a liquid tight seal between the second end of the second length of tubing and the first hollow protrusion.

14. The baby bottle assembly of claim 6 wherein the bottle insert includes a flange having an outer circumference greater than or equal to a circumference of the mouth, the baby bottle assembly further comprising:

a locking ring configured to engage the neck of the receptacle and secure the flange of the bottle insert between the threaded neck and the locking ring, wherein the neck is externally threaded and the bottle insert is held in position by threaded engagement of the locking ring and the neck.

15. The baby bottle assembly of claim 6 wherein in operation the diaphragm forms a liquid tight seal over the apertures when fluid is not being removed from the receptacle via the nipple.

16. The baby bottle assembly of claim 9 wherein the second length of tubing extends along a height of the receptacle.

17. The baby bottle assembly of claim 14 wherein the apertures are positioned below the flange.

18. The baby bottle assembly of claim 7 wherein the first hollow protrusion is a cylindrical hollow protrusion.

19. The baby bottle assembly of claim 6 wherein in operation an inner flap of the diaphragm is configured to:

form a liquid tight seal over the apertures when fluid is not being removed from the receptacle; and unseal the apertures when fluid is being removed from the receptacle.

20. The baby bottle assembly of claim 6 wherein:

the collar is internally threaded;

the collar insert is externally threaded; and the collar is configured to threadedly engage the collar insert.

21. A baby bottle assembly comprising:

a nipple;

a collar configured to receive a bottom portion of the nipple;

a collar insert configured to be coupled to the collar;

a receptacle comprising a mouth and a neck;

a bottle insert configured to be positioned on the receptacle, the bottle insert comprising apertures and a hole;

a diaphragm configured to be coupled to the bottle insert, wherein in operation the diaphragm seals the apertures when the receptacle is in a pressure equilibrium state and unseals the apertures when the receptacle is in a state of less pressure than the pressure equilibrium state; and a length of tubing comprising a first end and a second end, the length of tubing being configured to pass through the hole and, in operation:

the first end is positioned in the receptacle;

the second end is coupled to the collar insert; and the length of tubing transfers liquid from the receptacle to the nipple via the first end and the second end.

* * * * *